US008081896B2

(12) United States Patent
Sasaki

(10) Patent No.: US 8,081,896 B2
(45) **Date of Patent: *Dec. 20, 2011**

(54) IMAGE FORMING METHOD AND APPARATUS FOR CONVENIENT REPLACEMENT OF DEVELOPER CONTAINER

(75) Inventor: Tomohiko Sasaki, Tokyo-to (JP)

(73) Assignee: Ricoh Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/942,707

(22) Filed: Nov. 9, 2010

(65) Prior Publication Data

US 2011/0052257 A1 Mar. 3, 2011

Related U.S. Application Data

(63) Continuation of application No. 11/282,731, filed on Nov. 21, 2005, now Pat. No. 7,860,423.

(30) Foreign Application Priority Data

Nov. 19, 2004 (JP) ..... 2004-335298

(51) Int. Cl.
*G03G 15/00* (2006.01)

(52) U.S. Cl. ..... 399/81; 399/28; 399/107; 399/258

(58) Field of Classification Search ..... 399/81, 399/28, 107, 258

See application file for complete search history.

(56) References Cited

U.S. PATENT DOCUMENTS

| | | | |
|---|---|---|---|
| 4,559,519 | A | 12/1985 | Matsumoto et al. |
| 4,866,486 | A | 9/1989 | Higashio et al. |
| 5,909,609 | A | 6/1999 | Yahata et al. |
| 6,115,564 | A | 9/2000 | Morimoto |
| 6,463,231 | B2 | 10/2002 | Numazu et al. |
| 6,535,702 | B1 | 3/2003 | Takatsu |
| 7,620,345 | B2 | 11/2009 | Ishii et al. |
| 7,853,167 | B2 | 12/2010 | Sasaki |
| 2001/0055499 | A1 | 12/2001 | Sato |
| 2003/0118367 | A1 | 6/2003 | Omata et al. |

(Continued)

FOREIGN PATENT DOCUMENTS

| | | |
|---|---|---|
| JP | 04-180072 | 6/1992 |
| JP | 9-156125 | 6/1997 |
| JP | 2002-214868 | 7/2002 |
| JP | 2002-362807 | 12/2002 |

(Continued)

OTHER PUBLICATIONS

Interview with Examiner issued May 30, 2011, in Japan Patent Application No. 2010-141078.

*Primary Examiner* — David Porta
*Assistant Examiner* — Bryan Ready
(74) *Attorney, Agent, or Firm* — Oblon, Spivak, McClelland, Maier & Neustadt, L.L.P.

(57) ABSTRACT

An image forming apparatus includes an image forming mechanism for forming an image, at least one developer container replaceably provided in the image forming apparatus for containing developer, a housing for housing the image forming mechanism and the at least one developer container, and an operation device provided on the housing. The housing includes at least one openable portion opened for replacement of the at least one developer container. The operation device includes an instruction display part for indicating a message prompting opening of the at least one openable portion, and at least one developer-end display part for indicating depletion or near-depletion of the developer contained in any one of the at least one developer container. The at least one developer-end display part and the instruction display part are placed adjacent to each other and are viewable from a front side of the image forming apparatus.

14 Claims, 5 Drawing Sheets

U.S. PATENT DOCUMENTS

| | | | |
|---|---|---|---|
| 2004/0208676 | A1 | 10/2004 | Ishii et al. |
| 2005/0206923 | A1 | 9/2005 | Utsumi et al. |
| 2006/0110178 | A1 | 5/2006 | Sasaki |
| 2007/0065174 | A1 | 3/2007 | Rennick et al. |

FOREIGN PATENT DOCUMENTS

| | | |
|---|---|---|
| JP | 2003-050351 | 2/2003 |
| JP | 2004-085887 | 3/2004 |
| JP | 2004-188638 | 7/2004 |
| JP | 2004-317883 | 11/2004 |

IMAGE FORMING METHOD AND APPARATUS FOR CONVENIENT REPLACEMENT OF DEVELOPER CONTAINER

CROSS REFERENCE TO RELATED APPLICATION

This application is a continuation of U.S. application Ser. No. 11/282,731, filed Nov. 21, 2005, now U.S. Pat. No. 7,860, 423, which claims priority to Japanese patent application no. 2004-335298 filed on Nov. 19, 2004, the entire contents of each of which are hereby incorporated by reference herein.

BACKGROUND OF THE INVENTION

1. Field of the Invention

The present invention relates to an image forming method and apparatus, such as a color printer, a color copier, a color facsimile machine, and a complex machine thereof, and more particularly to an image forming method and apparatus allowing convenient replacement of members included in the image forming apparatus, such as developer containers.

This application claims priority to Japanese patent application no. 2004-335298 filed on Nov. 19, 2004, the entire contents of which are hereby incorporated by reference herein.

2. Description of the Related Art

In recent years, color image forming apparatuses according to an electrographic method for forming a color image on a recording medium, such as a sheet and a film, have been widely used. This type of color image forming apparatus is increasingly used as a printer, for example, in connection with a personal computer. That is, the color image forming apparatus is increasingly personalized. For convenience, a user of such color image forming apparatus often prefers to place the color image forming apparatus close to the user's working space. In this case, it is preferable to reduce the height of the color image forming apparatus for enhancing the user's working efficiency, and to downsize the color image forming apparatus (e.g., reduce the width of the color image forming apparatus) for saving space. Further, from the viewpoint of personalization of the color image forming apparatus and reduction in maintenance cost of the color image forming apparatus, it is desirable for users that the color image forming apparatus is designed to be easy to perform replacement and maintenance works of consumable components, such as a toner which serves as a developer (i.e., development agent).

In this type of color image forming apparatus, a color image is generally formed by using toners of four colors as the developers. The color image forming apparatus, therefore, includes a larger number of components than a monochrome image forming apparatus and thus tends to be larger in size. Further, a per-unit-time number of recording mediums output from the color image forming apparatus (i.e., a color printing speed) tends to be reduced. In light of the above, there is a tandem-type color image forming apparatus in which a plurality of photoconductors are placed in a line and provided with a corresponding plurality of development devices in their vicinity. Thus configured, the tandem-type color image forming apparatus forms a plurality of single-color toner images on the respective plurality of photoconductors and sequentially transfers the plurality of single-color toner images onto a recording medium.

The tandem-type color image forming apparatus generally consumes a relatively large amount of toner. In view of a user's working efficiency, it is preferable to separately provide a development device from a developer supplying unit which supplies toner to the development device, rather than integrating the development device with the developer supplying unit within a cartridge. Further, in some of the tandem-type color image forming apparatuses, recording mediums on which color images have been formed are discharged to and stacked on an upper portion of such color tandem-type image forming apparatuses to save space.

The tandem-type color image forming apparatuses are, however, still open to further improvements in terms of usability thereof.

For example, the tandem-type color image forming apparatuses need to have a plurality of developer-storing containers (i.e., toner bottles) for a corresponding plurality of toner colors.

If these toner bottles can be checked by visual examination, the user's working efficiency is expected to increase. In a background color image forming apparatus, for example, a plurality of toner bottles are placed in a line such that a lateral direction of the plurality of toner bottles is perpendicular to a direction of discharging recording mediums, i.e., the respective toner bottles of four colors are sequentially placed along the direction of discharging the recording mediums.

However, placement of the toner bottles and display on an operation panel of background color image forming apparatuses seem not to be sufficiently based on usability for users who are unfamiliar to structures of the background image forming apparatuses, replacement works of components included in the background image forming apparatuses, and so forth. Under such circumstances, some users find it complicated and thus are reluctant to personally check the toner bottles and perform the replacement for such components.

SUMMARY OF THE INVENTION

This patent specification describes an image forming apparatus. In one example, an image forming apparatus includes an image forming mechanism for forming an image, at least one developer container, a housing, and an operation device. The at least one developer container is replaceably provided in the image forming apparatus and is configured to contain developer. The housing is configured to house the image forming mechanism and the at least one developer container. The housing includes at least one openable portion configured to be opened for replacement of the at least one developer container. The operation device is provided on the housing and includes an instruction display part and at least one developer-end display part. The instruction display part is configured to indicate a message prompting opening of the at least one openable portion. The at least one developer-end display part is configured to indicate depletion or near-depletion of the developer contained in any one of the at least one developer container. The at least one developer-end display part and the instruction display part are placed adjacent each other and are viewable from a front side of the image forming apparatus.

This patent specification further describes another image forming apparatus. In one example, another image forming apparatus includes an image forming mechanism for forming an image, a plurality of developer containers, a housing, and an operation device. The plurality of developer containers are arranged in parallel along a sheet-discharging direction, and each of the plurality of developer containers is configured to contain developer. The housing is configured to house the image forming mechanism and the plurality of developer containers. The housing includes at least one openable portion configured to be opened for replacement of any one of the plurality of developer containers. The at least one openable portion includes an upper openable portion configured to be opened to reveal the plurality of developer containers to be externally viewable. The operation device is provided on the housing and includes an instruction display part and a plurality of developer-end display parts. The instruction display part is configured to indicate a message prompting opening of the at least one openable portion. Each of the plurality of developer-end display parts is configured to indicate either depletion or near-depletion of the developer contained in any one of the plurality of the developer containers. The plurality of developer-end display parts and the instruction display part are placed adjacent each other and are viewable from a front side of the image forming apparatus.

This patent specification further describes another image forming apparatus. In one example, another image forming apparatus includes image forming means for forming an image, at least one developer containing means, housing means, and operation means. The at least one developer containing means is replaceably provided in the image forming apparatus for containing developer. The housing means houses the image forming means and the at least one developer containing means. The housing means includes at least one openable means for being opened for replacement of the at least one developer containing means. The operation means is provided on the housing means and includes instruction display means and at least one developer-end display means. The instruction display means indicates a message prompting opening of the at least one openable means. The at least one developer-end display means indicates either depletion or near-depletion of the developer contained in any one of the at least one developer containing means. The at least one developer-end display means and the instruction display means are placed adjacent each other and are viewable from a front side of the image forming apparatus.

This patent specification further describes another image forming apparatus. In one example, another image forming apparatus includes an image forming means for forming an image, a plurality of developer containing means, housing means, and operation means. The plurality of developer containing means contain developer and is arranged in parallel along a sheet-discharging direction. The housing means houses the image forming means and the plurality of developer containing means. The housing means includes at least one openable means for being opened for replacement of any one of the plurality of developer containing means. The at least one openable means includes an upper openable means opened for revealing the plurality of developer containing means so as to be externally viewable. The operation means is provided on the housing means and includes instruction display means and a plurality of developer-end display means. The instruction display means indicates a message prompting opening of the at least one openable means. The plurality of developer-end display means indicates any one of depletion and near-depletion of the developers contained in any one of the plurality of the developer containing means. The plurality of developer-end display means and the instruction display means are placed adjacent to each other and are viewable from a front side of the image forming apparatus.

This patent specification further describes an image forming method. In one example, an image forming method of includes the steps of placing, in a housing, an image forming mechanism and at least one developer container containing developer, the at least one developer container being replaceably provided; providing the housing with at least one openable portion opened for replacing the at least one developer container, using an operation device including an instruction display part and at least one developer-end display part, the instruction display part and the at least one developer-end display part being placed adjacent to each other and being viewable from a front side of the image forming apparatus; forming an image by the image forming mechanism; indicating, through the at least one developer-end display part, either depletion or near-depletion of the developer contained in any one of the at least one developer container; and indicating, through the instruction display part, a message prompting opening of the at least one openable portion.

This patent specification further describes another image forming method. In one example, another image forming method includes: providing, in a housing, an image forming mechanism and a plurality of developer containers each containing developer, the plurality of developer containers being arranged in parallel along a sheet-discharging direction; providing the housing with at least one openable portion opened for replacing any one of the plurality of developer containers, the at least one openable portion including an upper openable portion opened to reveal the plurality of developer containers to be externally viewable; providing the housing with an operation device including an instruction display part and a plurality of developer-end display parts, the instruction display part and the plurality of developer-end display parts being placed adjacent each other and being viewable from a front side of the image forming apparatus; forming an image by the image forming mechanism; indicating, through the plurality of developer-end display parts, either depletion or near-depletion of the developer contained in any one of the plurality of developer containers; and indicating, through the instruction display part, a message prompting opening of the at least one openable portion.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
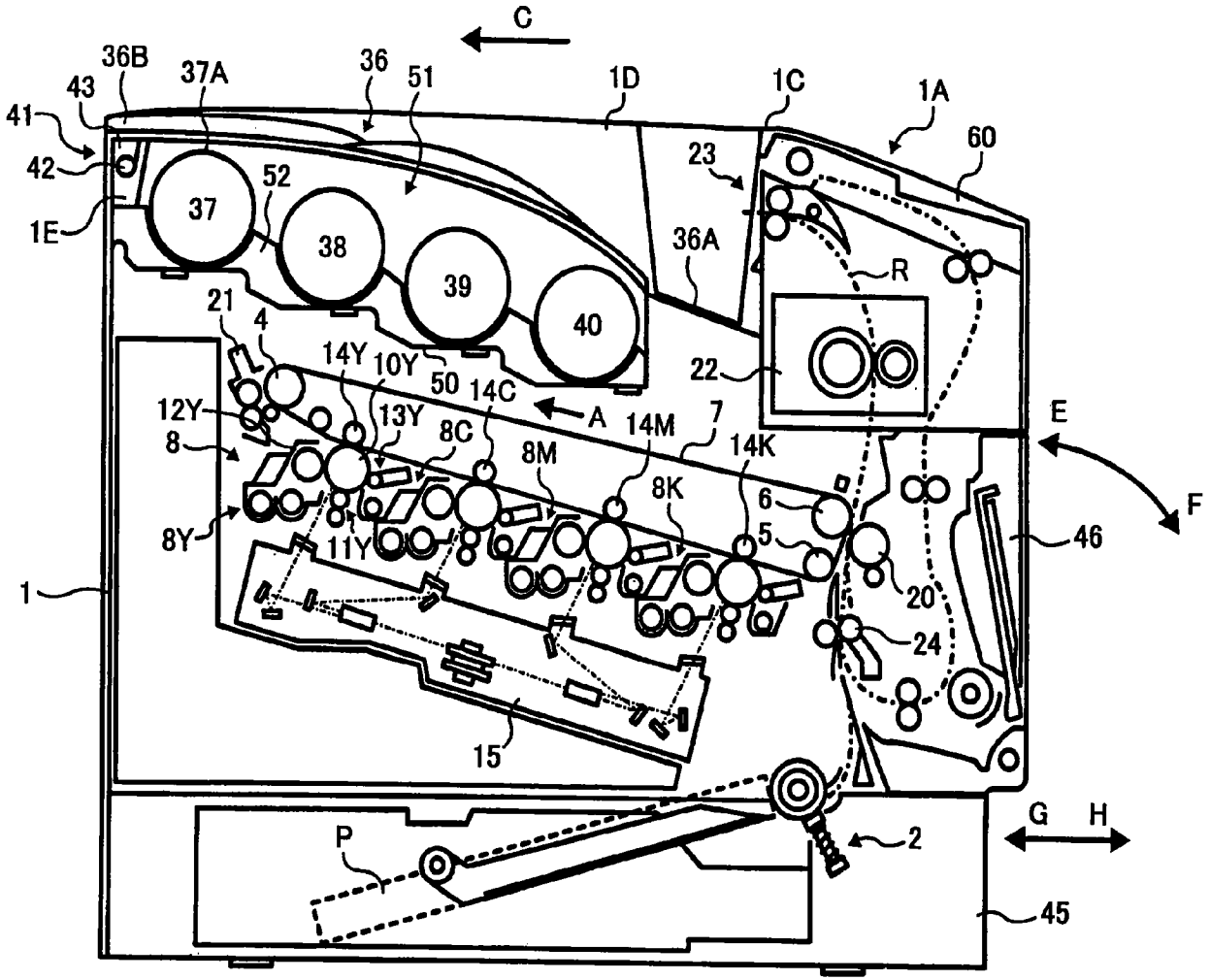
FIG. 1 is a sectional view of an image forming apparatus according to an embodiment of the present invention.

In describing the embodiments illustrated in the drawings, specific terminology is employed for the purpose of clarity. However, the disclosure of this patent specification is not intended to be limited to the specific terminology so used, and it is to be understood that substitutions for each specific element can include any technical equivalents that operate in a similar manner.

Figure 2:
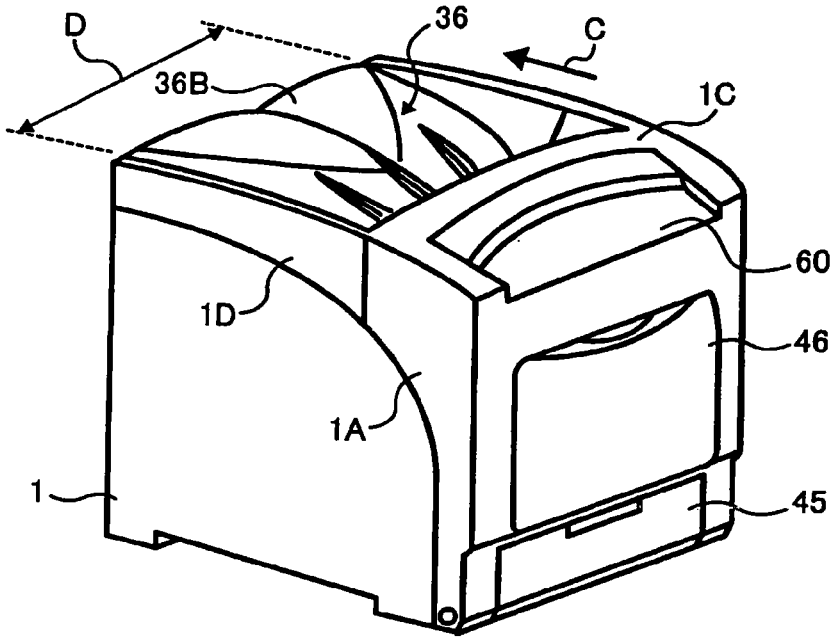
FIG. 2 is a perspective view of the image forming apparatus illustrated in FIG. 1.
Figure 3:
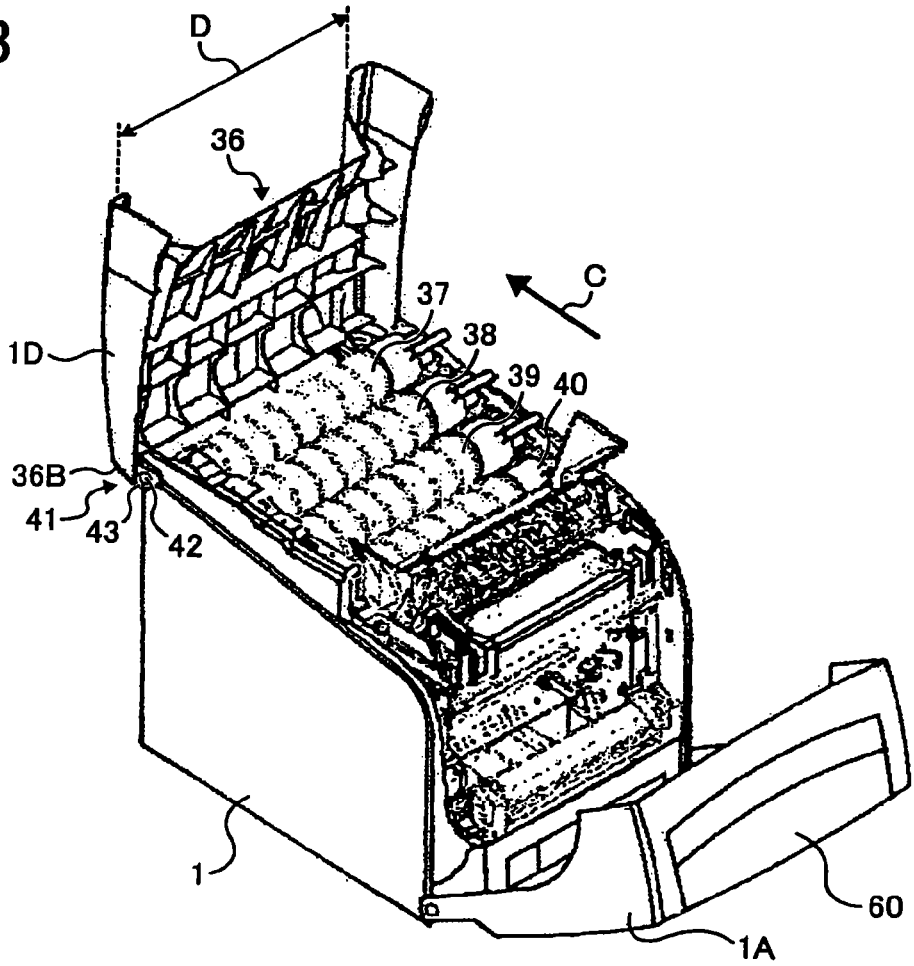
FIG. 3 is a perspective view of the image forming apparatus illustrated in FIG. 1, with an upper portion thereof lifted open.

Referring now to the drawings, wherein like reference numerals designate identical or corresponding parts throughout the several views, particularly to FIGS. 1 to 3, a configuration and functions of an image forming apparatus 1 according to an exemplary embodiment of the present invention are described.

FIG. 1 illustrates a sectional view of the image forming apparatus 1. The image forming apparatus 1 in the present example is a tandem-type color printer capable of forming a full-color image. The image forming apparatus 1 is not, however, limited to the printer illustrated in the present drawing but may also be another type of image forming apparatus, such as a copier, a facsimile machine, and a complex machine thereof.

The image forming apparatus 1 illustrated in FIG. 1 includes a sheet-feeding unit 2, a plurality of rollers 4, 5, and 6, an intermediate transfer belt 7, image forming units 8Y, 8C, 8M, and 8K, first transfer rollers 14Y, 14C, 14M, and 14K, an optical writing unit 15, a second transfer roller 20, an intermediate transfer belt cleaning unit 21, a fixing unit 22, a sheet-discharging unit 23, a resisting roller pair 24, a sheet-stacking area 36, toner bottles 37, 38, 39, and 40, a fulcrum portion 41, a shaft 42, a shaft-bearing 43, a sheet-feeding cassette 45, a tray 46, a divider plate 50, a toner bottle housing space 51, a holder 52, and an operation panel 60.

In the image forming apparatus 1 illustrated in FIG. 1, the sheet-feeding unit 2 including the sheet-feeding cassette 45 is located in a lower part of the image forming apparatus 1 to store a recording medium P. The-feeding cassette 45 is opened in a direction H and closed in a direction G. The image forming units 8Y, 8C, 8M, and 8K are placed above the sheet-feeding unit 2 to respectively form toner images of yellow (Y), cyan (cyan), magenta (M), and black (K) colors. Each of the image forming units 8Y, 8C, 8M, and 8K (i.e., image forming unit 8) includes an image carrying member 10 (i.e., a photoconductor drum in the present example), a charging unit 11, a developing unit 12, and an image carrying member cleaning unit 13 of a corresponding color. FIG. 1 illustrates, as an example, an image carrying member 10Y, a charging unit 11Y, a developing unit 12Y, and an image carrying member cleaning unit 13Y included in the image forming unit 8Y. Similarly, 10C, 10M, and 10K, charging units 11C, 11M, and 11K, developing units 12C, 12M, and 12K, and image carrying member cleaning units 13C, 13M, and 13K are included in the corresponding image carrying members 8C, 8M, and 8K, respectively, although their reference numbers are omitted for simplification in FIG. 1.

In the image forming unit 8, the image carrying member 10 contacts the intermediate transfer belt 7 and is surrounded by the charging unit 11, the developing unit 12, and the image carrying member cleaning unit 13. Further, the first transfer roller 14 for performing a first transferring operation is placed on an inner surface of the intermediate transfer belt 7 at a position where the image carrying member 10 contacts the intermediate transfer belt 7. The image forming units 8Y, 8C, 8M, and 8K are basically similar in structure. A differences among the image forming units 8Y, 8C, 8M, and 8K lies in the colors of the toners stored in the respective developing units 12Y, 12C, 12M, and 12K.

The intermediate transfer belt 7 is a flexible endless belt passing over the plurality of rollers 4, 5, and 6. The optical writing unit 15 performs an optical writing operation to each of the image carrying members 10Y, 10C, 10M, and 10K. The fixing unit 22 fixes a toner image on the recording medium P. In FIG. 1, a dotted-and-dashed line R extending from the sheet-feeding unit 2 to the fixing unit 22 indicates a sheet path along which the recording medium P is conveyed. The roller 6 is positioned along the sheet path R.

A portion of the intermediate transfer belt 7 flanked by the rollers 4 and 5 forms a lower side of the intermediate transfer belt 7. The roller 6 faces the second transfer roller 20 via the intermediate transfer belt 7 at a position on the sheet path R. Meanwhile, the roller 4 faces, via the intermediate transfer belt 7, the intermediate transfer belt cleaning unit 21 which cleans an outer surface of the intermediate transfer belt 7.

The image forming units 8Y, 8C, 8M, and 8K are placed below the intermediate transfer belt 7 to face the lower side of the intermediate transfer belt 7.

The optical writing unit 15, which is located below the image forming units 8Y, 8C, 8M, and 8K in the present example, applies optically-modulated laser beams to surfaces of the respective image carrying members 10Y, 10C, 10M, and 10K to form thereon latent images of the respective colors.

Upon start of an image forming operation, a driving device (not illustrated) drives to rotate the respective image carrying members 10Y, 10C, 10M, and 10K in a clockwise direction. Then, the charging units 11Y, 11C, 11M, and 11K uniformly charge the surfaces of the respective image carrying members 10Y, 10C, 10M, and 10K to a predetermined polarity. The surfaces of the image carrying members 10Y, 10C, 10M, and 10K thus charged are applied with the optically-modulated laser beams by the optical writing unit 15. As a result, the latent images of the respective colors are formed on the surfaces of the image carrying members 10Y, 10C, 10M, and 10K. In this exposure process, data of a desired full-color image is divided into single-color data sets of the respective colors, i.e., yellow, cyan, magenta, and black. Based on the thus formed single-color data sets, the surfaces of the respective image carrying members 10Y, 10C, 10M, and 10K are exposed. When the image carrying members 10Y, 10C, 10M, and 10K contact the corresponding developing units 12Y, 12C, 12M, and 12K, the latent images formed on the surfaces of the image carrying members 10Y, 10C, 10M, and 10K are developed into visible toner images by the toners stored in the developing units 12Y, 12C, 12M, and 12K.

One of the plurality of rollers 4, 5, and 6 passing over the intermediate transfer belt 7 is driven to rotate in a counterclockwise direction by a driving device (not illustrated). Accordingly, the intermediate transfer belt 7 is driven to rotate in a counterclockwise direction A in FIG. 1, and the other two of the plurality of rollers 4, 5, and 6 are also driven to rotate. As the intermediate transfer belt 7 rotates, a yellow toner image formed by the image forming unit 8Y is first transferred to the outer surface of the intermediate transfer belt 7 by the first transfer roller 14Y. Then, a cyan toner image formed by the image forming unit 8C, a magenta toner image formed by the image forming unit 8M, and a black toner image formed by the image forming unit 8K are sequentially superimposed on the yellow toner image. Thus, a full-color toner image is formed on the outer surface of the intermediate transfer belt 7.

After the respective toner images are transferred from the image carrying members 10Y, 10C, 10M, and 10K to the intermediate transfer belt 7, toner remaining on the surfaces of the respective image carrying members 10Y, 10C, 10M, and 10K are removed by the image carrying member cleaning units 13Y, 13C, 13M, and 13K, respectively. Then, electricity on the surfaces of the respective image carrying members 10Y, 10C, 10M, and 10K is removed by neutralization devices (not illustrated). Accordingly, potentials of the surfaces of the respective image carrying members 10Y, 10C, 10M, and 10K are initialized in preparation for a subsequent image forming operation.

Meanwhile, the recording medium P is sent out from the sheet-feeding unit 2 and conveyed along the sheet path R. The recording medium P is then fed by the resisting roller pair 24 into a nip formed by the roller 6 and the second transfer roller 20 at an appropriate sheet-feeding timing. The resisting roller pair 24 is located at an upstream position of the second transfer roller 20 in a sheet-conveying direction. In this process, the second transfer roller 20 is applied with a transfer voltage of a polarity opposite the polarity of the toner included in the toner image carried on the intermediate transfer belt 7. As a result, the toner image carried on the intermediate transfer belt 7 (i.e., the full-color toner image formed by the four single-color toner images) is transferred from the outer surface of the intermediate transfer belt 7 onto the recording medium P. The recording medium P to which the toner image has been transferred is then conveyed to the fixing unit 22 and has heat and pressure applied thereto, so that the toner image is fused and fixed on the recording medium P. Thereafter, the recording medium P on which the toner image has been fixed is conveyed to the sheet-discharging unit 23 which is located at an end of the sheet path R in an upper part of the image forming apparatus 1. Then, the recording medium P is discharged to the sheet-stacking area 36 which forms an upper portion of the image forming apparatus 1. After the toner image is transferred from the outer surface of the intermediate transfer belt 7 to the recording medium P, toner remaining on the outer surface of the intermediate transfer belt 7 is removed by the intermediate transfer belt cleaning unit 21.

In the thus configured image forming apparatus 1, the four image forming units 8Y, 8C, 8M, and 8K face the intermediate transfer belt 7 so that the toner images of the respective colors formed by the image forming units 8Y, 8C, 8M, and 8K are transferred to the intermediate transfer belt 7, with the toner images of the respective colors sequentially superimposed. According to the image forming apparatus 1, therefore, the time required for performing the image transferring operation is substantially reduced, compared with an image forming apparatus which uses a single image forming unit having four developing units for performing the image transferring operation of transferring toner images from the image forming unit to the intermediate transfer belt and then to the recording medium P.

Further, forming the upper portion of the image forming apparatus 1, the sheet-stacking area 36 does not outwardly protrude from the image forming apparatus 1. As a result, the size of the image forming apparatus 1 is reduced.

The image forming apparatus 1 forms a full-color image on the recording medium P, as described above. The image forming apparatus 1 can also form a single-color image by using one of the image forming units 8Y, 8C, 8M, and 8K. Similarly, the image forming apparatus 1 can form a two-color image or a three-color image by using two or three of the image forming units 8Y, 8C, 8M, and 8K. Further, the image forming apparatus 1 can form a monochrome (i.e., black-and-white) image by forming a latent image on the image carrying member 10K included in the image forming unit 8K, developing the latent image into a black toner image by the image forming unit 8K, transforming the black toner image to the recording medium P, and fixing the black toner image on the recording medium P by the fixing unit 22.

As described above, the sheet-discharging unit 23 is provided in the upper part of the image forming apparatus 1 on a right side in FIG. 1. The sheet-discharging unit 23 is covered by an outer cover 1A which is also in the upper part of the image forming apparatus 1 on the right side in FIG. 1. As illustrated in FIG. 2, the operation panel 60 and the tray 46 are provided on the outer cover 1A such that a user of the image forming apparatus 1 can operate the operation panel 60 and the tray 46 from a front side of the image forming apparatus 1 (i.e., the right side in FIG. 1). The tray 46 can be opened in the direction F and closed in the direction E illustrated in FIG. 1.

Operations of the image forming apparatus 1 are performed through the operation panel 60. The tray 46 stores thereon the recording medium P. In the present example, the operation panel 60 is located at the right side of the image forming apparatus 1 where the sheet-discharging unit 23 is provided. Alternatively, the operation panel 60 may be provided at another side of the image forming apparatus 1.

As illustrated in FIG. 1, the divider plate 50 is provided below the sheet-stacking area 36 in the image forming apparatus 1. The divider plate 50 is located between the sheet-stacking area 36 and an upper side of the intermediate transfer belt 7 such that the toner bottle housing space 51 is formed in the image forming apparatus 1. In the toner bottle housing space 51, the toner bottles 37, 38, 39, and 40 are provided below the sheet-stacking area 36 such that the direction perpendicular to a sheet-discharging direction C (i.e., direction of discharging the recording medium P) corresponds to the longitudinal direction of each of the toner bottles 37, 38, 39, and 40, as illustrated in FIGS. 1 and 3. The toner bottles 37, 38, 39, and 40 contain the yellow toner, the cyan toner, the magenta toner, and the black toner, respectively. The toner bottles 37, 38, 39, and 40 are connected to the developing units 12Y, 12C, 12M, and 12K of the image forming units 8Y, 8C, 8M, and 8K, respectively, via toner supply paths (not illustrated). Therefore, as the toner in any one of the developing units 12Y, 12C, 12M, and 12K decreases in amount, toner is supplied from a corresponding one of the toner bottles 37, 38, 39, and 40.

Further, the toner bottles 37, 38, 39, and 40 are arranged in the toner bottle housing space 51 in an ascending order from the toner bottle 40 (i.e., the toner bottle closest to the sheet-discharging unit 23) to the toner bottle 37 (i.e., the toner bottle farthest from the sheet-discharging unit 23) such that the toner bottle 40 is at the lowest level and the toner bottle 37 is at the highest level among the four toner bottles 37, 38, 39, and 40. The sheet-discharging unit 23 is at a higher level than the toner bottle 40 and at an approximately equal level to the toner bottle 37.

Furthermore, the toner bottles 37, 38, 39, and 40 are detachably held by the holder 52 in the toner bottle housing space 51. The holder 52 holds up the toner bottles 37, 38, 39, and 40 so that the toner bottles 37, 38, 39, and 40 can be attached to and detached from the image forming apparatus 1 in a space above the image forming apparatus 1 within a width D indicated in FIGS. 2 and 3. The direction of the width D is perpendicular to the sheet-discharging direction C within a single plane. Being held by the holder 52, the toner bottles 37, 38, 39, and 40 are appropriately positioned in the image forming apparatus 1.

The sheet-stacking area 36 is formed on the image forming apparatus 1 to extend from a position below the sheet-discharging unit 23 toward the sheet-discharging direction C. The sheet-stacking area 36 includes an outer cover 1D to cover the toner bottles 37, 38, 39, and 40 housed in the toner bottle housing space 51. Further, the sheet-stacking area 36 is shaft-supported on the image forming apparatus 1 so as to be opened and closed with respect to the image forming apparatus 1 in up-and-down directions, respectively. The fulcrum portion 41 is provided on an outer cover 1E, which is at a left side of the toner bottle 37 in FIG. 1. The fulcrum portion 41 is positioned at a lower level than a top portion 37A of the toner bottle 37. As illustrated in FIGS. 1 and 3, the fulcrum portion 41 includes the shaft 42 and the shaft bearing 43. The shaft 42 is provided on the image forming apparatus 1 in parallel with the width D perpendicular to the sheet-discharging direction C. The shaft bearing 43 is provided on a side of an end portion 36B of the sheet-stacking area 36 to support the shaft 42. Thus configured, the sheet-stacking area 36 formed by the outer cover 1D is lifted up to depart from the sheet-discharging unit 23, i.e., from a position at which a user operates the image forming apparatus 1, and is lifted down to approach the sheet-discharging unit 23. The sheet-stacking area 36 can be lifted up to a higher position than a position of the outer cover 1A provided with the operation panel 60.

The sheet-stacking area 36 is formed to be somewhat larger in size than the recording medium P sent out from the sheet-feeding unit 2. Further, the sheet-stacking area 36 is formed in a slope such that an end portion 36A close to the sheet-discharge unit 23 is at a lower level than the other end portion 36B distant from the sheet-discharge unit 23. The end portion 36A (i.e., a lowest portion of the sheet-stacking area 36) is lower in level than a part of the sheet-discharge unit 23 from which the recording medium P is discharged. Meanwhile, the end portion 36B (i.e., a highest portion of the sheet-stacking area 36) is at an approximately equal level to a highest portion 1C of the outer cover 1A.

With the configuration described above, the toner bottles 37, 38, 39, and 40 are detachably provided in the image forming apparatus 1 so as to be attached to and detached from the image forming apparatus 1 in the space above the image forming apparatus 1 within the width D. Therefore, replacement work for replacing the toner bottles 37, 38, 39, and 40 can be performed in the space above the image forming apparatus 1 within the width D. Accordingly, the usability of the image forming apparatus 1 is improved, and replacement of components of the image forming apparatus 1 can be conveniently performed.

As described above, the toner bottles 37, 38, 39, and 40 are placed in parallel and in the ascending order from the toner bottle 40 to the toner bottle 37. Therefore, when viewed from the position at which a user operates the image forming apparatus 1 (i.e., from a side of the sheet-discharging unit 23), the toner bottles 37, 38, 39, and 40 are well viewable, not hidden by the sheet-discharging unit 23. Accordingly, the usability of the image forming apparatus 1 is improved, and replacement of a component of the image forming apparatus 1 can be conveniently performed.

With the fulcrum portion 41 being provided on the outer cover 1E at the left side of the toner bottle 37 distant from the sheet-discharging unit 23, the sheet-stacking area 36 is opened and closed with respect to the image forming apparatus 1 around the fulcrum portion 41. When the sheet-stacking area 36 is lifted open, therefore, the area of the toner bottle 37 (i.e., the toner bottle located close to the fulcrum portion 41) hidden by the sheet-stacking area 36 is reduced. Further, the sheet-stacking area 36 is opened and closed in the directions of departing from and approaching the position at which a user operates the image forming apparatus 1. Therefore, the sheet-stacking area 36 can be opened and closed in a convenient manner. Further, the toner bottles 37, 38, 39, and 40 are easily viewable from the position at which a user operates the image forming apparatus 1. As a result, the usability of the image forming apparatus 1 is improved, and replacement of a component of the image forming apparatus 1 can be conveniently performed. Furthermore, the fulcrum portion 41 is provided at a lower level than the top portion 37A of the toner bottle 37. Therefore, the height of the sheet-stacking area 36, when it is lifted up, is reduced. Thus, the toner bottles 37, 38, 39, and 40 are easily viewable from the position at which a user operates the image forming apparatus 1, with the size of the image forming apparatus 1 not increased. Accordingly, the usability of the image forming apparatus 1 is improved, and replacement of a component of the image forming apparatus 1 can be conveniently performed.

Further, the sheet-stacking area 36 can be lifted up to a position higher than the outer cover 1A on which the operation panel 60 is provided. Therefore, the toner bottles 37, 38, 39, and 40 are easily viewable from the position at which a user operates the image forming apparatus 1. Accordingly, the usability of the image forming apparatus 1 is improved, and replacement of a component of the image forming apparatus 1 can be conveniently performed.

Figure 4:
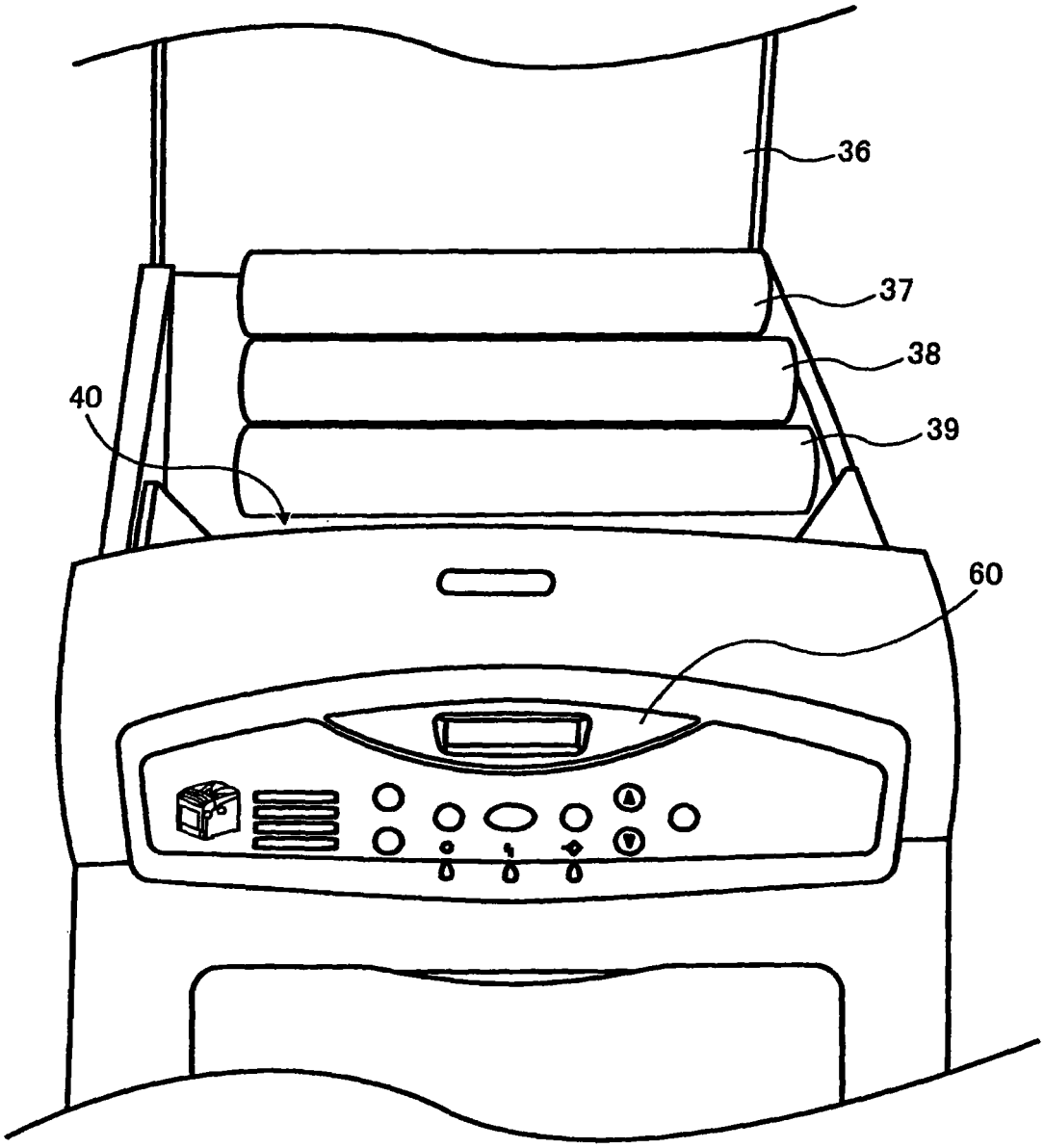
FIG. 4 is a perspective view of the image forming apparatus illustrated in FIG. 1, as viewed in another angle.
Figure 5A:
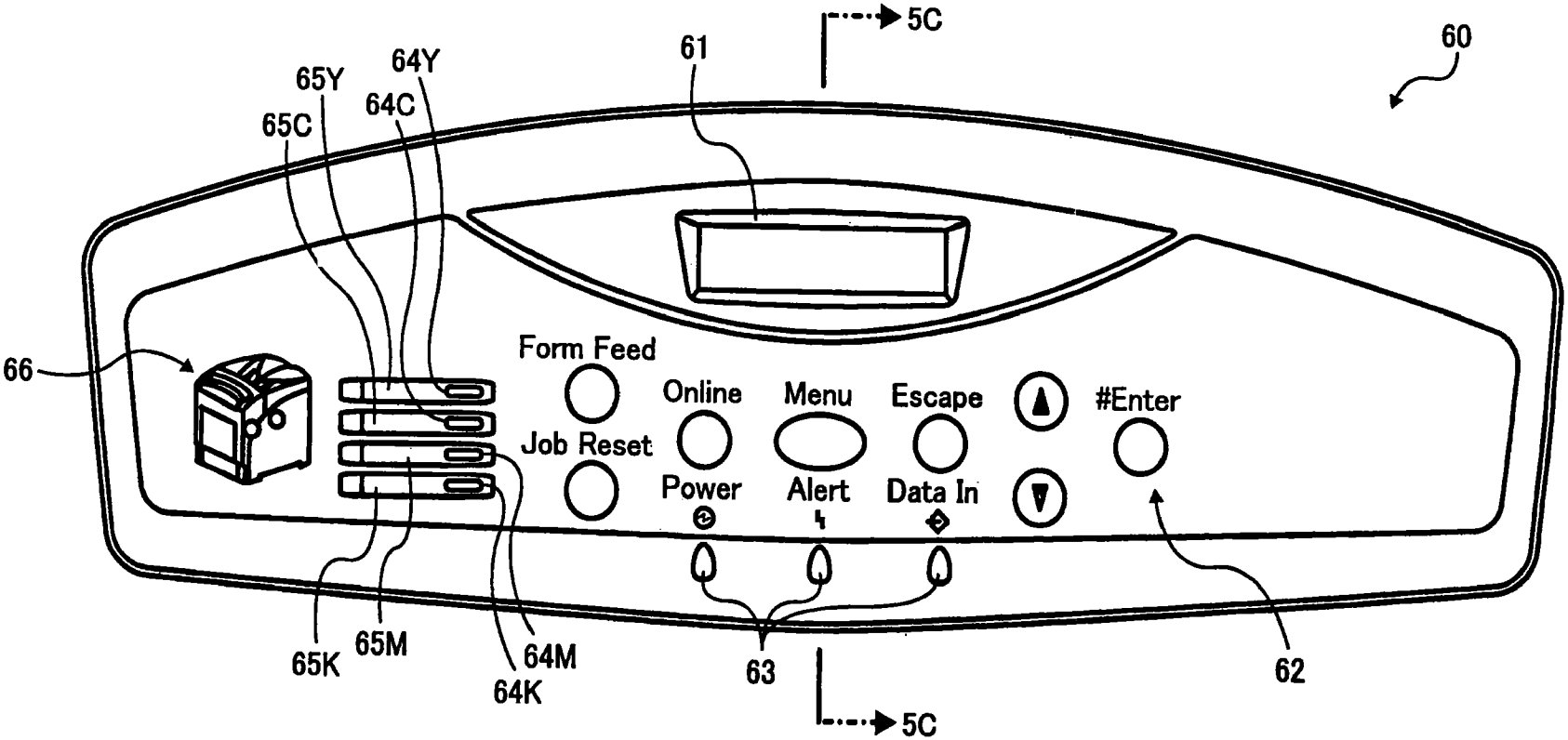
FIG. 5A is a plan view of an operation panel of the image forming apparatus illustrated in FIG. 4.
Figure 5C:
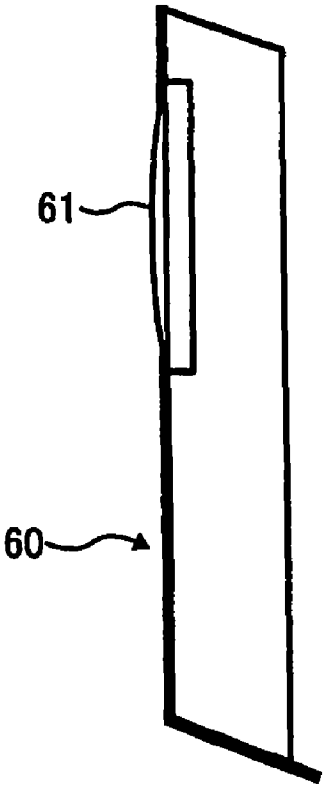
FIG. 5C is a sectional view of the operation panel illustrated in FIG. 5A cut along a line 5C-5C.
Figure 5B:
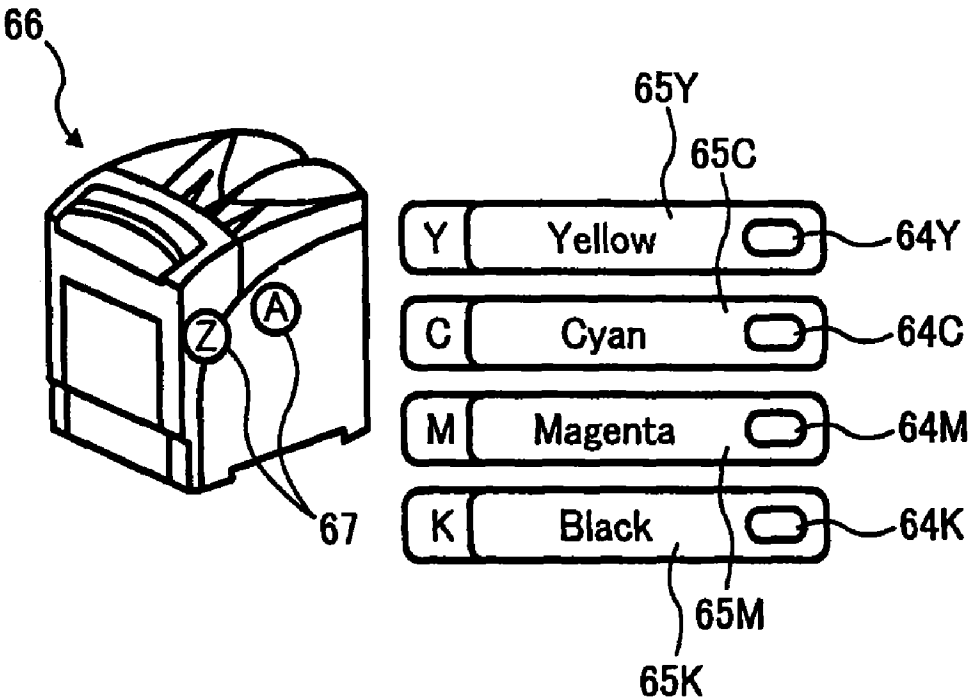
FIG. 5B is an enlarged plan view of a part of the operation panel illustrated in FIG. 5A.

With reference to FIGS. 4 and 5A to 5C, the operation panel 60 is described. FIG. 4 illustrates the image forming apparatus 1, as viewed from the front side thereof. FIG. 5A is a plane view of the operation panel 60. FIG. 5B is an enlarged view of a part of the operation panel 60. FIG. 5C is a sectional view cut across a line 5C-5C in FIG. 5A.

In FIG. 4, the sheet-stacking area 36 which forms a top cover of the image forming apparatus 1 is lifted open, and the toner bottles 37, 38, and 39 excluding the front-most toner bottle 40 are viewable. As described above, the four toner bottles 37, 38, 39, and 40 are placed in a line such that the longitudinal direction of each of the toner bottles 37, 38, 39, and 40 is perpendicular to the direction of discharging of a recording medium P on which an image has been formed. That is, the toner bottles 37, 38, 39, and 40 are placed in a line along the direction of discharging the recording medium P.

As illustrated in FIG. 5A, the operation panel 60 includes a liquid crystal screen 61, operation buttons 62, LED (light-emitting diode) lenses 63, LEDs 64Y, 64C, 64M, and 64K, labels 65Y, 65C, 65M, and 65K, and an illustration 66. General functions and operations of components of the operation panel 60, such as the liquid crystal screen 61 and the operation buttons 62, are well known. Therefore, the functions and operations of the above components of the operation panel 60 are briefly described below.

The liquid crystal screen 61 displays a message indicating an operation performed, for example. The operation buttons 62 are pressed for performing a variety of operations. The LED lenses 63 indicate whether the image forming apparatus 1 is turned on or off, for example. The LEDs 64Y, 64C, 64M, and 64K indicate "toner-end" (i.e., a condition in which toner has run out) and "toner-near-end" (i.e., a condition in which toner has nearly run out), for example. The labels 65Y, 65C, 65M, and 65K are provided adjacent to the corresponding LEDs 64Y, 64C, 64M, and 64K. In the present example, the labels 65Y, 65C, 65M, and 65K are elongated rectangles extending in a direction parallel to the longitudinal direction of each of the toner bottles 37, 38, 39, and 40. The illustration 66 is provided on the left side of the labels 65Y, 65C, 65M, and 65K for indicating which part of the image forming apparatus 1 needs to be opened for performing a necessary operation.

As illustrated in FIG. 4, according to the image forming apparatus 1, a user can properly see both the operation panel 60 and the toner bottles 37, 38, 39, and 40 from the user's position which is usually at the front side of the image forming apparatus 1. As illustrated in FIGS. 4 and 5A, the LEDs 64Y, 64C, 64M, and 64K and the corresponding labels 65Y, 65C, 65M, and 65K are arranged in an order corresponding to an order of the toner bottles 37, 38, 39, and 40 provided in the image forming apparatus 1, which respectively contain the yellow toner, the cyan toner, the magenta toner, and the black toner. Therefore, when one of the LEDs 64Y, 64C, 64M, and 64K is turned on to indicate the toner-end or the toner-near-end, a user can easily see which one of the toner bottles 37, 38, 39, and 40 is in a state of the toner-end or the toner-near-end. Further, the user can be prevented from replacing a wrong toner bottle.

The illustration 66 includes marks 67 (e.g., circled letters "A" and "Z" illustrated in FIG. 5B). Using an light emitter (not illustrated) such as an LED provided on an inside of the operation panel 60, each of the marks 67 indicates a specific part of the image forming apparatus 1 which needs to be opened for a necessary operation. Therefore, when the sheet-stocking area 36 which forms the top cover of the image forming apparatus 1 needs to be opened for solving a paper jam problem, for example, a user can refer to the illustration 66 to find a part of the image forming apparatus 1 which needs to be opened (i.e., the sheet-stocking area 36). Also, if there are a plurality of parts to be opened, the user can see the order of opening the plurality of parts by checking the illustration 66. Accordingly, an operator of the image forming apparatus 1, such as an individual user and a service personnel, can smoothly perform any necessary operation such as a paper jam solving operation, without referring to much other information.

The above-described embodiments are illustrative, and numerous additional modifications and variations are possible in light of the above teachings. For example, elements and/or features of different illustrative and exemplary embodiments herein may be combined with each other and/or substituted for each other within the scope of this disclosure and appended claims. It is therefore to be understood that within the scope of the appended claims, the disclosure of this patent specification may be practiced otherwise than as specifically described herein.

The invention claimed is:

1. An image forming apparatus comprising:

an image forming mechanism for forming a toner image;

a plurality of toner containers in the image forming apparatus and to contain a toner used to form an image, the plurality of toner containers including at least three toner containers, each including a different color of toner;

a housing to house the image forming mechanism and the plurality of toner containers, the housing comprising:

at least one door to be opened for access to and replacement of the plurality of said toner containers; and a user interface at an upper portion of the housing, the user interface comprising:

an input device to receive input from a user; and a display to indicate a status of the toner used to form the image, the display being viewable from a front of the image forming apparatus, the status including an indication that there is no toner of a particular color for use in the image forming apparatus, wherein said plurality of toner containers are in parallel in line in the image forming apparatus in a first predetermined sequence according to colors of the toner, and wherein a plurality of indicators are in parallel in line on the display in a second predetermined sequence according to indications of colors, the first and second predetermined sequences corresponding to each other, each of the plurality of indicators being adjacent to no more than two others of the plurality of indicators.

2. The image forming apparatus as claimed in claim 1, wherein said colors of the toner comprise yellow, cyan and magenta colors.

3. The image forming apparatus as claimed in claim 1, wherein said plurality of indicators are provided ahead of said plurality of toner containers.

4. The image forming apparatus as claimed in claim 1, wherein among said plurality of indicators and said plurality of toner containers, a black color is provided ahead of all other colors.

5. The image forming apparatus as claimed in claim 1, wherein:

the at least one door is pivotal about a fulcrum portion and is configured to be opened to reveal the plurality of toner containers so as to be externally viewable, said fulcrum portion being positioned at a lower level than a top portion of said plurality of toner containers; and said display being positioned on a sheet discharging unit and being located on an upper, front side of the image forming apparatus.

6. The image forming apparatus as claimed in claim 1, wherein:

the user interface is pivotally attached to the image forming apparatus.

7. The image forming apparatus as claimed in claim 6, wherein:

the user interface is attached to a cover, and the cover is pivotally attached to the image forming apparatus.

8. The image forming apparatus as claimed in claim 1, wherein:

the user interface which is to display an instruction regarding movement of the door displays an instruction regarding opening.

9. The image forming apparatus as claimed in claim 1, wherein:

the user interface which is to display an instruction regarding movement of the door displays an instruction related to a paper jam.

10. The image forming apparatus as claimed in claim 1, wherein:

the user interface is to indicate the status of the toner contained in any one of the plurality of toner containers, the status indicating at least a depletion of the toner.

11. The image forming apparatus as claimed in claim 1, wherein:

the display is to indicate the status of the toner contained in any one of the plurality of toner containers, the status indicating at least a near-depletion of the toner.

12. The image forming apparatus as claimed in claim 1, wherein:

the display is to indicate the status of the toner contained in any one of the plurality of toner containers, the status indicating a near-depletion and a depletion state of the toner.

13. The image forming apparatus according to claim 1, wherein the plurality of toner containers in the image forming apparatus and the display are disposed at positions such that the display and the plurality of toner containers are simultaneously visible.

14. The image forming apparatus according to claim 13, wherein the display is rotatably attached to the image forming apparatus.

* * * * *